United States Patent [19]

Stoffel

[11] Patent Number: 5,069,590

[45] Date of Patent: Dec. 3, 1991

[54] PROCESS FOR PRODUCING A TWO-CHAMBER PRESSURIZED PACKAGE

[76] Inventor: Gerd Stoffel, In den Dorfackern 21, D-7750 Konstanz, Fed. Rep. of Germany

[21] Appl. No.: 605,110

[22] Filed: Oct. 26, 1990

Related U.S. Application Data

[63] Continuation-in-part of Ser. No. 301,842, Jan. 25, 1989, abandoned.

[30] Foreign Application Priority Data

Jan. 27, 1988 [DE] Fed. Rep. of Germany ..... 3802314

[51] Int. Cl.[5] ..... B21D 51/26

[52] U.S. Cl. ..... 413/1; 53/449; 53/470

[58] Field of Search ..... 53/449, 470, 474; 413/1, 2, 4, 6, 7; 72/348; 220/3, 22, 22.1

[56] References Cited

U.S. PATENT DOCUMENTS 4,185,758 1/1980 Giggard ..... 53/470
4,308,973 1/1982 Irland ..... 220/454

FOREIGN PATENT DOCUMENTS 2620294 5/1976 Fed. Rep. of Germany .
2705549 2/1977 Fed. Rep. of Germany .

*Primary Examiner*—Bruce M. Kisliuk
*Assistant Examiner*—Jack Lavinder
*Attorney, Agent, or Firm*—Bachman & LaPointe

[57] ABSTRACT

Process for producing a two-chamber pressurized package having an outer body enclosing an interior space which can be subjected to pressure and forms an opening through which an inner body of a material which can be folded or crumpled is inserted. A valve is fitted thereon and the outer and inner bodies are connected to one another in a predetermined region.

11 Claims, 2 Drawing Sheets

PROCESS FOR PRODUCING A TWO-CHAMBER PRESSURIZED PACKAGE

CROSS-REFERENCE TO RELATED APPLICATION

This application is a Continuation-In-Part of copending application Ser. No. 301,842, filed Jan. 25, 1989 now abandoned.

BACKGROUND OF THE INVENTION

The invention relates to a process for producing a two-chamber pressurized package having an outer body which encloses an interior space, which can be subjected to pressure, and forms an opening through which an inner body of a material which can fold or be crumpled is inserted.

As a rule, two-chamber pressurized packages of this kind are today used to replace the known pressurized containers employing a propellant gas. The medium is dispensed from the inner body by the subjection to pressure of the interior space of the outer body. The medium to be dispensed therefore does not come into contact with this pressure medium but is forced out through a valve by alteration of the inner body.

These known two-chamber pressurized packages essentially comprise three parts, namely the outer body, for example an aluminum sleeve having a base, the inner body, for example a very thin aluminum sleeve and a funnel which is placed on the orifice edge of the inner and outer body and surrounds the latter sealingly. The appropriate valve is then inserted centrally in this discoid funnel.

It is precisely the fitting of the funnel onto the orifice edges of the inner and outer body which requires a considerable amount of work, since this has to be done by hand. The funnel is rolled or flanged together with the orifice edges. It therefore requires a certain space. Since the valve itself in general likewise requires a diameter of 25 mm, the openings of the present-day two-chamber pressurized packages necessarily have a total diameter of about 40–65 mm. In between, only two-chamber pressurized packages having stepped dimensions are used.

The inventor has set himself the object of developing a process of the type mentioned above by means of which the fitting of the additional funnel is made superfluous, in which the interior space of the outer body is kept absolutely leakproof and in which two-chamber pressurized packages having various opening diameters can be produced, starting from as low as 1 inch, i.e. 25.4 mm.

SUMMARY OF THE INVENTION

This object is achieved by the fact that, prior to flanging, or the like, of the opening, filling of the inner body and fitting of a valve in the region of the orifice, the outer body and inner body are connected to one another in a predetermined region and are then folded over together to form a flanged edge.

This means that a leak-free connection between the inner body and outer body is produced even before the flanged edge is produced and hence that the interior space, which can be subjected to pressure, is kept absolutely leakproof.

The connection is preferably effected by welding, adhesive bonding, deformation or the like. The best solution here has proved to be a coating which is applied either to the outer body or to the inner body or to both in the connecting zone prior to the insertion of the inner body into the outer body. This coating, for example a suitable adhesive, can then dry, so that the inner body is inserted into the outer body without any alteration to the coating. After insertion, the two-chamber pressurized package preferably passes through an oven, in which the coating is liquefied. A certain connection is thereby produced already between the inner body and outer body. Since, however, in general, the inner body maintains a certain distance from the outer body so that, in the use position, it can be surrounded by sufficient pressure medium, it has proved to be advisable to introduce a tool into the opening of the two-chamber pressurized package, via which tool the inner body is pressed against the outer body in the appropriate connecting zone. This tool can be heated in order that the liquefaction of the coating may be effected or maintained by means of this heat.

Following the production of the connection between the inner body and outer body, the orifice edges are then flanged, this preferably being accomplished by rolling.

The inner space is henceforth absolutely leakproof. If leaks should occur, contrary to expectations, in the region of the connection, additional sealing material can be introduced through the opening which also serves for the subjection to pressure of the inner space, which then flows along the inner walls of the outer body and thus supplements the coating of the connecting zone.

In the final operation, all that is required now is for the two-chamber Pressurized package to be filled with the medium to be dispensed and for the valve to be fitted on, by means of which the inner body space is then also sealed, and for the propellant gas to be fed in via a hole in the base. This process in accordance with the invention furthermore has the advantage that both the outer body and the inner body can be given their final print, finish or the like even before flanging. Furthermore, in contrast to the hitherto conventional funnels, all standard internal protection finishes can be used. Flanging can be effected by means of an automatic machine, thus making considerable savings in terms of labor.

Furthermore the cutting edges of the outer body and of the inner body are hidden in the flanged edge or in the inside of the two-chamber pressurized package. According to this arrangement they do not corrode.

In an improved embodiment of the invention, a sealing compound covers the area of the flanged edge in which the folded edge contacts the inner surface of the inner body or lies partly on the inner body. The sealing compound is exposed to the inner pressure of the two-chamber pressurized package so that the cutting edges are absolutely isolated and the space between the outer body and the inner body is sealed. Furthermore the inwardly folding of the flanged edge has the important advantage that the contact height and the height of the pressurized package can be determined more exactly. It is not necessary to mill the outer sealing surface.

Further advantages, features and details of the invention emerge from the following description of preferred exemplary embodiments as well as with reference to the drawings in which.

DETAILED DESCRIPTION

Figure 1:
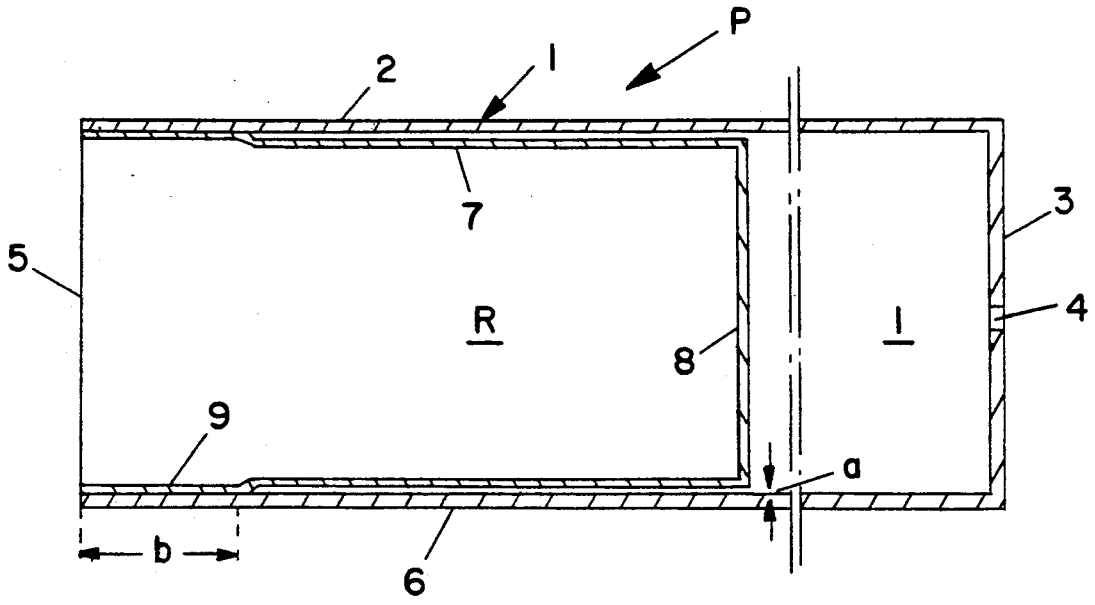
FIG. 1 shows a longitudinal section through a two-chamber pressurized package in accordance with the invention in a preliminary stage of production.

A two-chamber pressurized package P in accordance with the invention has a sleeve-shaped outer body 1 which, in the present exemplary embodiment, essentially comprises a cylindrical jacket 2 and a base cover 3. This outer body 1 can be produced, for example, by extrusion or deep drawing from a circular aluminum blank. The base cover 3 has a bore 4, via which the interior space I can be put under pressure. After this procedure, the bore 4 can be sealed.

An inner body 6 is inserted into a cylindrical opening 5 on the side opposite the base cover 3 of the outer body 1. This inner body 6 likewise has a cylindrical jacket 7 and has a continuous base cover 8. Overall, this inner body 6 consists of a relatively thin aluminum, with the result that it can be crumpled with the formation of folds.

Cylindrical jacket 7 and base cover 8 surround a space R which, in the use position, serves to accommodate a medium to be dispensed.

In the present exemplary embodiment, the inner body 6 maintains a distance a from the cylindrical jacket 2 of the outer body 1 over extensive areas. However, toward the cylinder opening 5, i.e. in the region of the orifice of outer body 1 and inner body 6, the inner body 6 or its cylindrical jacket 7 is connected in region b to the cylindrical jacket 2. The connection is effected, for example, by welding, adhesive bonding, laser welding, deformation or the like.

The production of this preliminary stage, in accordance with the invention, of a two-chamber pressurized package is accomplished as follows:

The outer body 1 is drawn from a circular aluminum blank. The bore 4 is introduced into the base 3 and the cylindrical jacket 2 is provided over the region b with a coating 9 of an adhesive or welded.

The inner body 6 is then inserted, the coating 9 having solidified, with the result that it does not hinder insertion.

The two-chamber pressurized package P now passes through an oven, in which the coating 9 is liquefied. As a result, a connection between cylindrical jacket 2 and cylindrical jacket 7 is initiated even at this stage. However, the connection proper is produced by a heated tool, which is introduced through the cylinder opening 5 and presses the cylindrical jacket 7 against the cylindrical jacket 2 in the region b.

Figure 2:
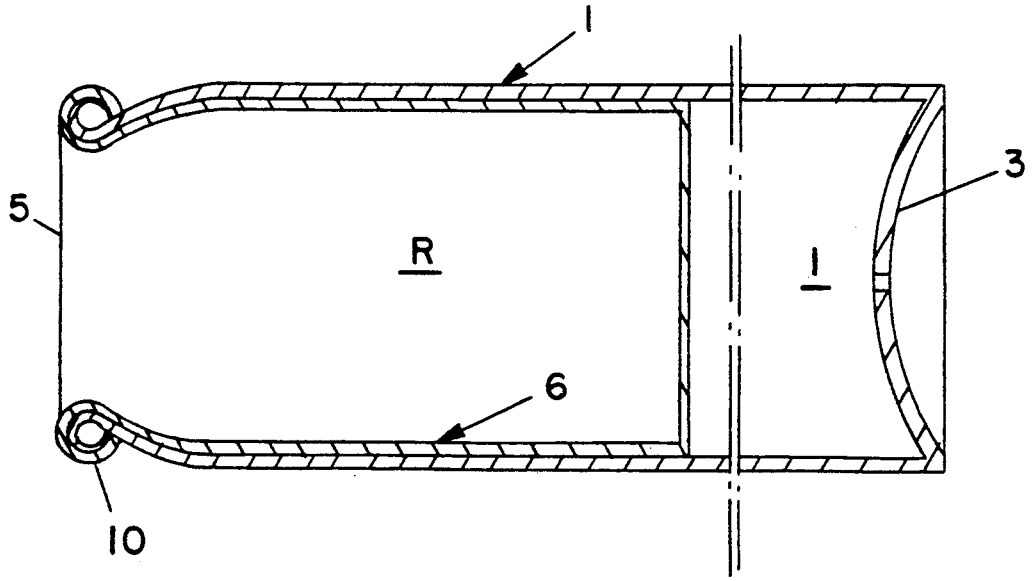
FIG. 2 shows another longitudinal section through the two-chamber pressurized package according to FIG. 1 at a further stage of production.

The next processing stage is shown in FIG. 2. Firstly in this processing stage, the base cover 3 is deformed, so that it can withstand an internal pressure in the interior space I and does not curve outwards.

Cylindrical jacket 2 and cylindrical jacket 7 are furthermore flanged outwards in the region of the cylinder opening 5, thus producing a flanged edge 10. During this procedure, cylindrical jacket 2 and cylindrical jacket 7 are simultaneously drawn inwards in a certain region.

In a further stage of production, the space R of the inner body 6 is now filled with the substance to be dispensed and the cylinder opening 5 is closed by means of a cover (not shown) with a valve. This cover seals the flanged edge 10. The interior space I of the outer body 1 is then put under pressure via the bore 4, whereupon the bore 4 is sealed. At the same time, however, the inner body 6 is put under pressure, with the result that when the valve is actuated the medium is dispensed from the space R of the inner body 6 through the valve, while the inner body 6 yields to the same extent to the pressure in the interior space of the outer body 1 and crumples.

If it should be found that leaks occur in the region of the coating 9 when the interior space I of the outer body 1 is subjected to pressure, there is the possibility of introducing further sealing material into the interior space I through the bore 4. This flows along the cylindrical jacket 2 to the coating 9, with the result that leakages can even be eliminated retrospectively.

Figure 3:
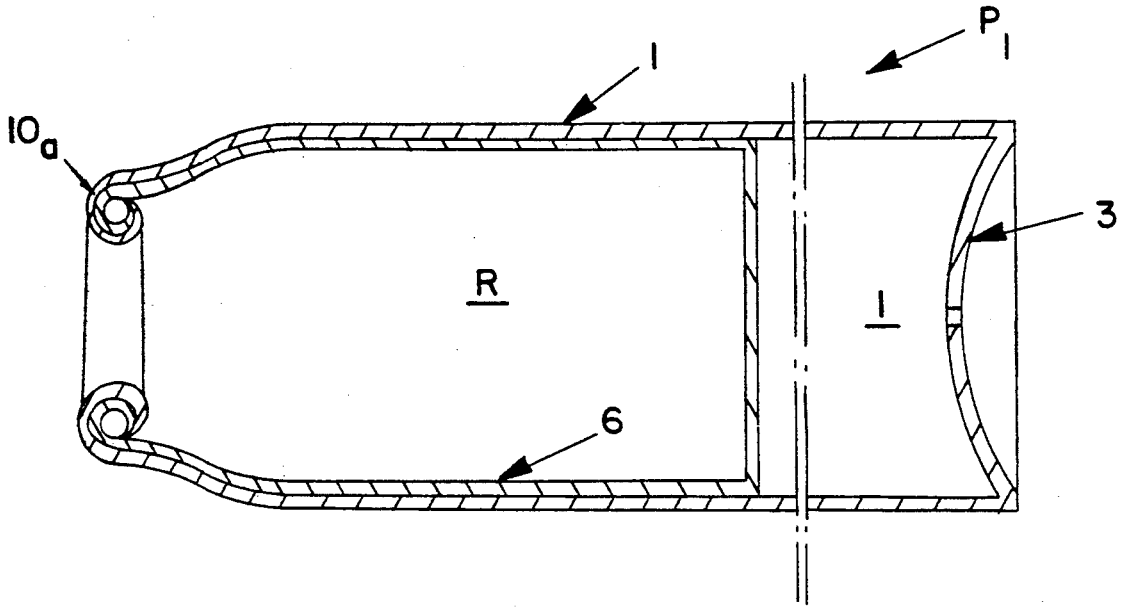
FIG. 3 shows a longitudinal section through a further embodiment of a two-chamber pressurized package according to the present invention in a stage of the production according to FIG. 2.
Figure 4:
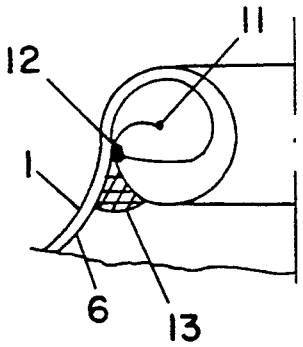
FIG. 4 shows an enlarged cross-section through the area of the flanged edge for the embodiment of FIG. 3.

In the embodiment of the two-chamber pressurized package P1 shown in FIG. 3, the flanged edge 10a is folded inwardly. The cutting edges 11 and 12 of the outer body 1 and the inner body 6 shown schematically in FIG. 4 are hidden so that no corrosion arises on the cutting edges.

Furthermore during the folding outwardly there is the danger that the inner body 6 builds crinkles in the area of the flanged edge which leads to difficulties with respect to the sealing with an attached valve lid. This does not happen during the inwardly folding of the flanged edge because the surface or skin of the outer body 1 is maintained facing outwardly.

It is also possible by an inwardly folded flanged edge that a sealing compound 13 is filled in the area of the contact of the outer body 1 and the inner body 6 in the inside R of the container. In this case the space R is filled with pressure and this pressure presses the sealing compound 13 in the said area against the inner body 6 and the outer body 1 so that the cutting edges 11 and 12 and also the space between the outer body 1 and the inner body 6 are absolutely isolated.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. Process for producing a two-chamber pressurized package which comprises: providing an outer body which encloses an interior space which can be subjected to pressure, said outer body having an opening therein suitable for receiving a cover and valve; inserting an inner body which can fold or be crumbled in the opening in the outer body and connecting the outer and inner bodies to each other in a pre-determined region to form a first chamber suitable for receiving a product and a second chamber suitable for receiving a pressurized gas; folding over a portion of the inner and outer bodies together to form a flanged edge consisting solely of the inner and outer bodies; wherein the connecting step takes place prior to the folding step and the folding step takes place prior to applying a cover and valve and prior to filling the first chamber.

2. Process according to claim 1 wherein the inner and outer bodies are connected to each other adjacent to said opening and wherein the folding step takes place adjacent to said opening.

3. Process according to claim 1 wherein the connecting step is selected from the group consisting of welding, adhesive bonding and deformation.

4. Process according to claim 1 wherein the connecting step takes place in a connecting zone and wherein a coating is provided in the connecting zone prior to insertion of the inner body in the opening in the outer body.

5. Process according to claim 4 wherein the coating is provided on the outer body.

6. Process according to claim 4 wherein said coating is liquified by heating following the insertion of the inner body in the opening in the outer body but prior to flanging.

7. Process according to claim 4 including the step of pressing the inner body against the outer body in said connecting zone.

8. Process according to claim 1 wherein said inner and outer body are folded inwardly towards said first chamber to form said flanged edge.

9. Process according to claim 8 wherein the inner and outer bodies have a cutting edge adjacent the first chamber and wherein said folding step covers the said cutting edges within the flanged edge.

10. Process according to claim 9 including the step of introducing a sealing compound in said flanged edge adjacent the inner and outer bodies.

11. Process according to claim 10 wherein the sealing compound is placed adjacent the first chamber so that pressure in the first chamber presses the sealing compound against the inner and outer bodies.

* * * * *